US008550210B2

(12) United States Patent
Kondou

(10) Patent No.: US 8,550,210 B2
(45) Date of Patent: Oct. 8, 2013

(54) RESONANT-TYPE MUFFLER

(75) Inventor: Takaharu Kondou, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/443,109

(22) Filed: Apr. 10, 2012

(65) Prior Publication Data

US 2012/0261210 A1 Oct. 18, 2012

(30) Foreign Application Priority Data

Apr. 18, 2011 (JP) ..... 2011-091975

(51) Int. Cl.
*F01N 1/04* (2006.01)

(52) U.S. Cl.
USPC ..... 181/251; 181/252; 181/253; 181/257; 181/268; 181/275

(58) Field of Classification Search
USPC ..... 181/227, 228, 232, 240, 251, 252, 253, 181/256, 257, 265, 268, 275
See application file for complete search history.

(56) References Cited

U.S. PATENT DOCUMENTS

| | | | | |
|---|---|---|---|---|
| 3,651,888 | A * | 3/1972 | Andres | 181/265 |
| 3,685,616 | A * | 8/1972 | Malkiewicz | 181/266 |
| 3,739,874 | A * | 6/1973 | Plaga, III | 181/250 |
| 6,467,570 | B1 * | 10/2002 | Herold | 181/231 |
| 7,174,991 | B1 * | 2/2007 | Gunnarsson et al. | 181/231 |
| 7,600,607 | B2 * | 10/2009 | Sullivan | 181/250 |
| 7,770,694 | B2 * | 8/2010 | Baars et al. | 181/229 |
| 2009/0014238 | A1 * | 1/2009 | Huff et al. | 181/265 |

FOREIGN PATENT DOCUMENTS

| | | | |
|---|---|---|---|
| JP | 58-33715 | U | 3/1983 |
| JP | 59-182619 | U | 12/1984 |
| JP | 6-22521 | U | 3/1994 |
| JP | 2004-137951 | A | 5/2004 |

* cited by examiner

*Primary Examiner* — Jeremy Luks
(74) *Attorney, Agent, or Firm* — Carrier Blackman & Associates, P.C.; William D. Blackman; Joseph P. Carrier

(57) ABSTRACT

A muffler comprising an inner pipe having one end connected to an upstream side of an exhaust pipe of an engine exhaust system, and another end connected to a downstream side of the exhaust pipe, an outer pipe covering at least part of the inner pipe, a hole being formed in a pipe wall of the inner pipe, a resonance chamber formed in a space between the inner pipe and the outer pipe, and a connection passage formed on an outer peripheral surface of the inner pipe along an axial direction of the inner pipe. The connection passage comprising a plurality of sections connected in series to form the connection passage as a single continuous passage.

20 Claims, 8 Drawing Sheets

FIG.8A TEMPORARILY FIX OUTER PASSAGE-FORMING MEMBER 30 AND INNER PASSAGE-FORMING MEMBER 20 BY SPOT-WELDING, AND THEN MIG-WELD THEM (w1) WITH OUTER PERIPHERAL SURFACE OF DOWNSTREAM-SIDE INNER PIPE 7d.

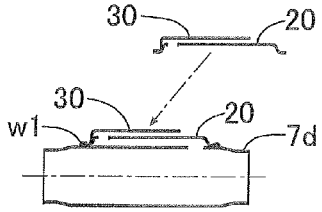

FIG.8B WIND STAINLESS WOOL 13, SOUND-ABSORBING MATERIALS 12, 11 AROUND OUTER PERIPHERY OF UPSTREAM-SIDE INNER PIPE 7u, AND FIT INNER PLATE 6 TO DOWNSTREAM END OF 7u. THEREAFTER, FIT FRONT END OF 7d TO RIGHT END OF 7u, AND THEN MIG-WELD (w2) 7d, 7u, AND 6 TOGETHER OVER ENTIRE PERIPHERIES, SO THAT SUBASSEMBLY SA IS MANUFACTURED.

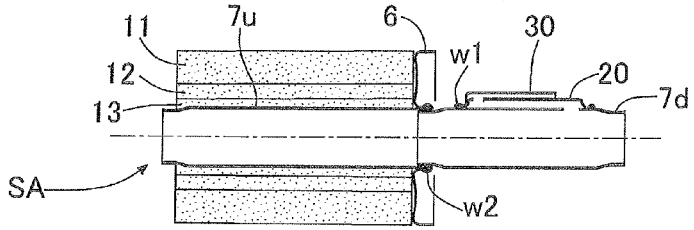

FIG.8C INSERT SUBASSEMBLY SA INTO OUTER PIPE 3, AND THEN FIT FRONT AND REAR END PLATES 4, 5 TO ENDS OF 3, RESPECTIVELY. LASER-WELD (w3, w4) OUTER PERIPHERIES THEREOF WITH 3 OVER ENTIRE PERIPHERIES.

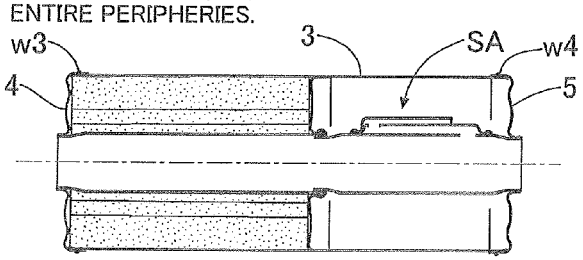

FIG.8D TEMPORARILY FIX SUPPORT HOLE OF 4 AND 7u TOGETHER AT ONE POSITION BY SPOT-WELDING, AND TEMPORARILY FIX SUPPORT HOLE OF 5 AND 7d TOGETHER AT ONE POSITION BY SPOT-WELDING. THEREAFTER, FIT UPSTREAM-SIDE EXHAUST PIPE 1u TO 7u, AND THEN MIG-WELD (w5) 4, 7u, AND 1u TOGETHER OVER ENTIRE PERIPHERIES. SUBSEQUENTLY, FIT DOWNSTREAM-SIDE EXHAUST PIPE 1d TO 7d, AND MIG-WELD (w6) 5, 7d, AND 1d TOGETHER OVER ENTIRE PERIPHERIES.

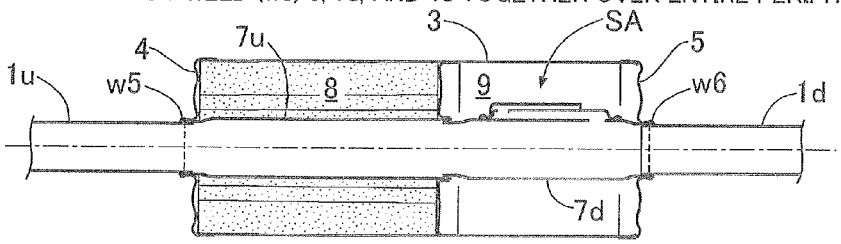

RESONANT-TYPE MUFFLER

CROSS-REFERENCE TO RELATED APPLICATIONS

The present invention claims priority under 35 USC §119 based on Japanese patent application No. 2011-091975 filed 18 Apr. 2011. The subject matter of this priority document is incorporated by reference herein.

BACKGROUND OF THE INVENTION

1. Field of the Invention

The present invention relates to a muffler connected to an exhaust system of an engine for an automobile or the like, and particularly relates to a resonant-type muffler capable of efficiently reducing exhaust noise of a particular frequency.

2. Description of the Related Art

There has heretofore been known a muffler which includes: an exhaust pipe provided in an exhaust system of an engine for an automobile; and an outer cylinder covering at least part of the exhaust pipe (see Japanese Utility Model Application Laid-open No. 6-22521 (Patent Document 1)). In the muffler, a space between the exhaust pipe and the outer cylinder is formed as a resonance chamber, and the inside of the exhaust pipe and the resonance chamber communicate with each other through a hole formed in a pipe wall of the exhaust pipe and a connection passage [a half-arc member and either a narrow pipe or a cylinder body]. The connection passage is formed on an outer peripheral surface of the exhaust pipe in the axial direction thereof and is connected to the hole on a base end side and to the resonance chamber on a tip end side.

The muffler is referred to as a resonant-type muffler. The resonant frequency of the resonance chamber is set at a particular frequency, so that the muffler can efficiently reduce exhaust noise of frequencies the same as and close to the resonant frequency.

Meanwhile, in the muffler described in Patent Document 1, if the frequency of exhaust noise to be reduced is to be shifted toward a lower frequency, the resonant frequency of the resonance chamber is accordingly shifted toward the lower frequency. In this case, the following techniques are conceivable as techniques of shifting the resonant frequency of the resonance chamber toward the lower frequency:

(1) The capacity of the resonance chamber is increased;

(2) The passage cross-sectional area of the connection passage is decreased; and (3) The passage length of the connection passage is increased.

However, the technique (1) above increases the volume of the resonance chamber, and thus has a problem of causing interference with vehicle components around the muffler. Technique (2) above suppresses air flow into and out of the resonance chamber, and thus makes resonance less likely to occur in the resonance chamber.

Thus, it is desirable to use the technique (3) above which increases the passage length of the connection passage for shifting the resonant frequency of the resonance chamber toward the lower frequency. However, if the connection passage is extended in the axial direction with no contrivance (e.g., is extended in a right direction in FIGS. 2, 3, 4, and 6 of Patent Document 1) in the muffler, there arises a problem. That is, since a space for extending the connection passage in the axial direction is small, the resonant frequency of the resonance chamber cannot be sufficiently shifted toward the lower frequency, and thus cannot be set at the desired lower frequency.

SUMMARY OF THE INVENTION

The present invention has been made under such circumstances, and an object of the present invention is to solve the problem by making it possible to secure a connection passage with a sufficiently long length and thereby to set the resonant frequency of a resonance chamber at a desired lower frequency even in a case where a space for extending the connection passage in an axial direction is small.

In order to achieve the above object, according to a first aspect and feature of the present invention, there is provided a muffler comprising: an inner pipe having one end connected to an upstream side of an exhaust pipe of an engine exhaust system, and another end connected to a downstream side of the exhaust pipe; an outer pipe covering at least part of the inner pipe, a hole being formed in a pipe wall of the inner pipe; a resonance chamber formed in a space between the inner pipe and the outer pipe; and a connection passage formed on an outer peripheral surface of the inner pipe along an axial direction of the inner pipe, the connection passage having a base end side connected to the hole and a tip end side connected to the resonance chamber, wherein an inside of the inner pipe and the resonance chamber communicate with each other through the hole and the connection passage, and wherein the connection passage comprises a plurality of sections connected in series to form the connection passage as a single continuous passage extending from said base end side thereof to said tip end side thereof, the plurality of sections having different distances from the outer peripheral surface of the inner pipe in a radial direction thereof and being mutually overlapped and extending in the axial direction on the outer peripheral surface of the inner pipe.

In order to achieve the above object, according to a second aspect and feature of the present invention, there is provided the muffler according to the first feature, wherein a plurality of passage-forming members each having a cross section of a protruding shape bulging outward in the radial direction from the outer peripheral surface of the inner pipe and having a closing portion on one end in a longitudinal direction thereof are stacked on the outer peripheral surface of the inner pipe such that the longitudinal direction coincides with the axial direction and that locations of the closing portions of adjacent ones of the passage forming members are opposed to each other. The closing portions close spaces formed inside the passage-forming members in the longitudinal direction, and the plurality of sections of the connection passage are formed as spaces between one of the passage forming-members and the inner pipe and between the passage-forming members.

According to the above aspects and features of the present invention, the connection passage connecting the hole formed in the pipe wall of the inner pipe and the resonance chamber is formed by the multiple sections connected in series, mutually overlapped, and extending in the axial direction as a single continuous passage. Thus, even if the length of the connection passage in the axial direction is limited, the length of the connection passage can be made sufficiently long. Thereby, the resonant frequency of the resonance chamber can be easily set at a desired lower frequency. This is particularly effective in the case where the resonance chamber is short in the axial direction and long in the radial direction as in an exemplary embodiment described below.

Moreover, according to the second aspect and feature of the present invention, the passage-forming members which have cross sections of protruding shapes bulging outward in the radial direction from the outer peripheral surface of the inner pipe and which have the closing portions on one ends in the longitudinal direction thereof can be easily manufactured due to their shape by press molding. Thus, it has excellent mass productivity and can achieve cost reduction.

The above and other objects, characteristics and advantages of the present invention will be clear from detailed descriptions of the exemplary embodiment which will be provided below while referring to the attached drawings.

BRIEF DESCRIPTION OF THE DRAWINGS

FIGS. 8A to 8D are views showing assembling steps of the muffler of FIG. 1.

DESCRIPTION OF THE PRESENT EXEMPLARY EMBODIMENT

An exemplary embodiment of the present invention will be described below with reference to the attached drawings.

In the following description, front, rear, right, left, up, and down are based on a direction of advancing of an automobile equipped with an exhaust system.

Figure 1:
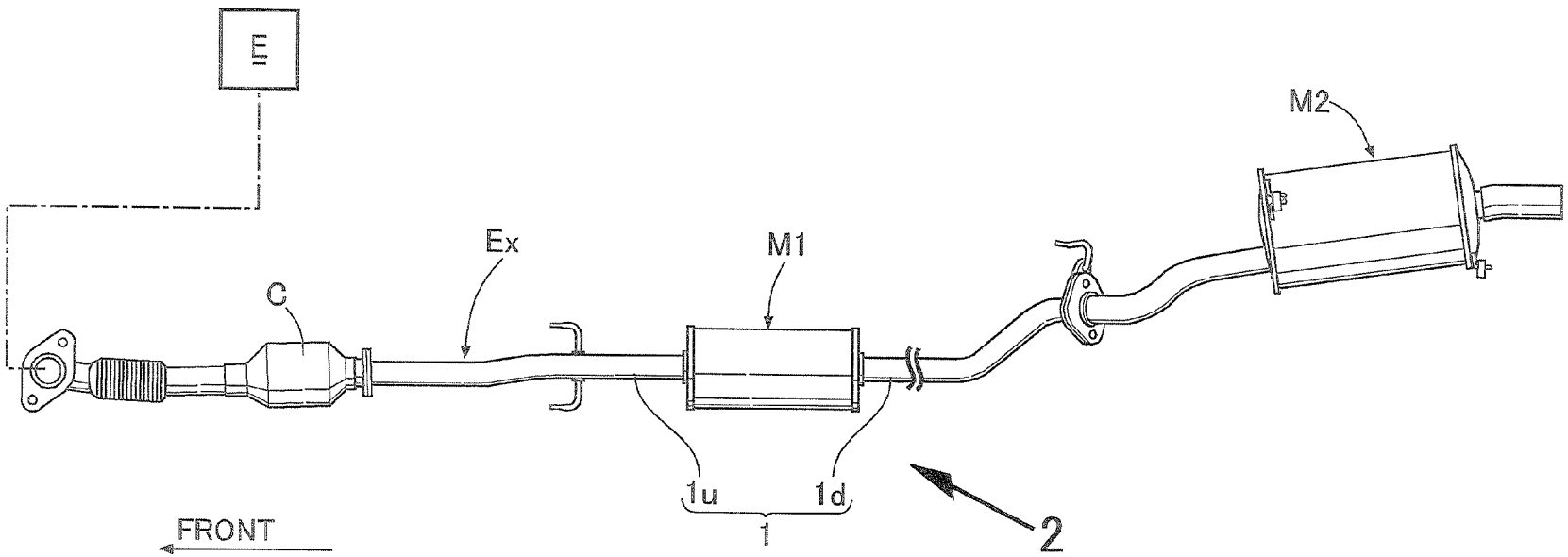
FIG. 1 is a side view showing an exhaust system including a muffler according to an exemplary embodiment of the present invention.

In FIG. 1, to an exhaust pipe 1 in an exhaust system Ex of an engine E for an automobile, a catalytic converter C, a first muffler M1, and a second muffler M2 are connected, respectively, from the upstream side to the downstream side. Exhaust gas discharged from the engine E mounted in a vehicle body of the automobile passes through the catalytic converter C where harmful components such as hydrocarbon (HC), carbon monoxide (CO), and nitrogen oxides (NOx) are cleaned up, then, enters the first muffler M1 where exhaust noise is subjected to first noise reduction, reaches the second muffler M2 where the exhaust noise is subjected to second noise reduction, and then is released to outside air.

A configuration of the first muffler (hereinafter, referred to as a muffler) M1 according to the present invention will be described below by referring to FIGS. 2 to 7.

The muffler M1 includes an absorption muffler Ma and a resonant-type muffler Mb which are located on the upstream side and the downstream side, respectively, and are connected adjacent to each other. A shell 2 forming an outer shell of the muffler M1 includes an outer pipe 3 having an elliptic cylindrical shape, and a front end plate 4 and a rear end plate 5 which respectively close opposite opening ends of the outer pipe 3. Outer peripheral edges of the front and rear end plates 4, 5 are respectively laser-welded (w3, w4) with outer peripheral surfaces of front and rear ends of the outer pipe 3 over their entire peripheries thereof. An outer peripheral surface of an inner plate 6, which separates the inside of the outer pipe 3 into front and rear portions, is fitted to an inner peripheral surface of an intermediate portion, in a longitudinal direction, of the outer pipe 3.

An inner pipe 7 extending along a center axis of the shell 2 is integrally coupled with the shell 2. The inner pipe 7 includes an upstream-side inner pipe 7*u* for the absorption muffler Ma and a downstream-side inner pipe 7*d* for the resonant-type muffler Mb, the upstream-side inner pipe 7*u* and the downstream-side inner pipe 7*d* being MIG-welded (w2) together over the entire peripheries. The inner pipe 7 penetrates through support holes in center portions of the front and rear end plates 4, 5 and the inner plate 6. A front end (an upstream-side end in an exhaust gas flowing direction) of the inner pipe 7 is MIG-welded (w5) with the support hole of the front end plate 4 over the pipe's entire periphery, a rear end (a downstream-side end in the exhaust gas flowing direction) thereof is MIG-welded (w6) with the support hole of the rear end plate 5 over the pipe's entire periphery, and further an intermediate portion thereof in a front-rear direction is MIG-welded (w2) with the support hole of the inner plate 6 over the pipe's entire periphery.

Figure 2:
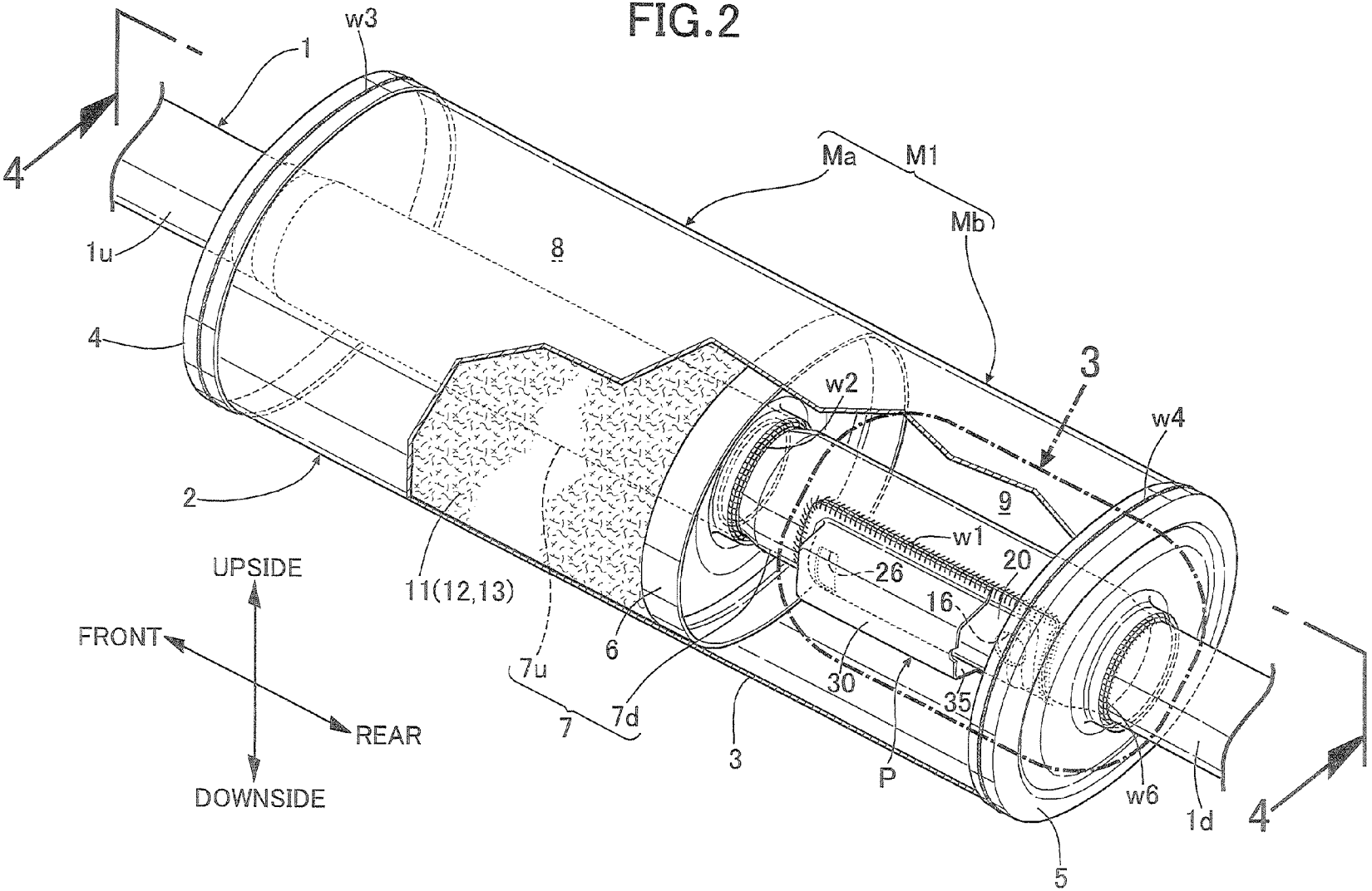
FIG. 2 is a partially cutaway perspective view of the muffler of FIG. 1 seen from a direction of an arrow 2 in FIG. 1.
Figure 3:
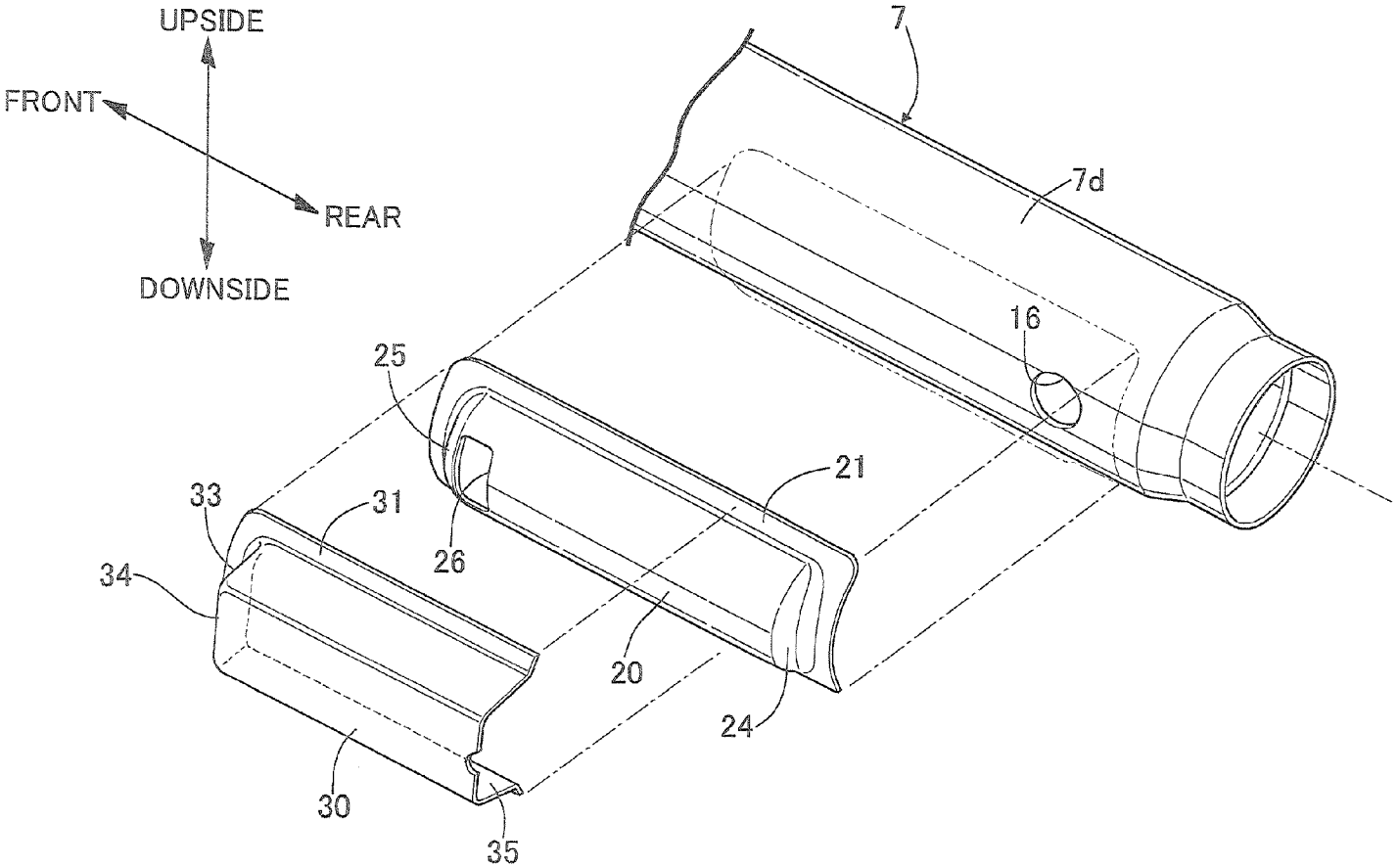
FIG. 3 is an exploded enlarged view of a part of the muffler surrounded by a virtual line indicated by an arrow 3 in FIG. 2;]
Figure 4:
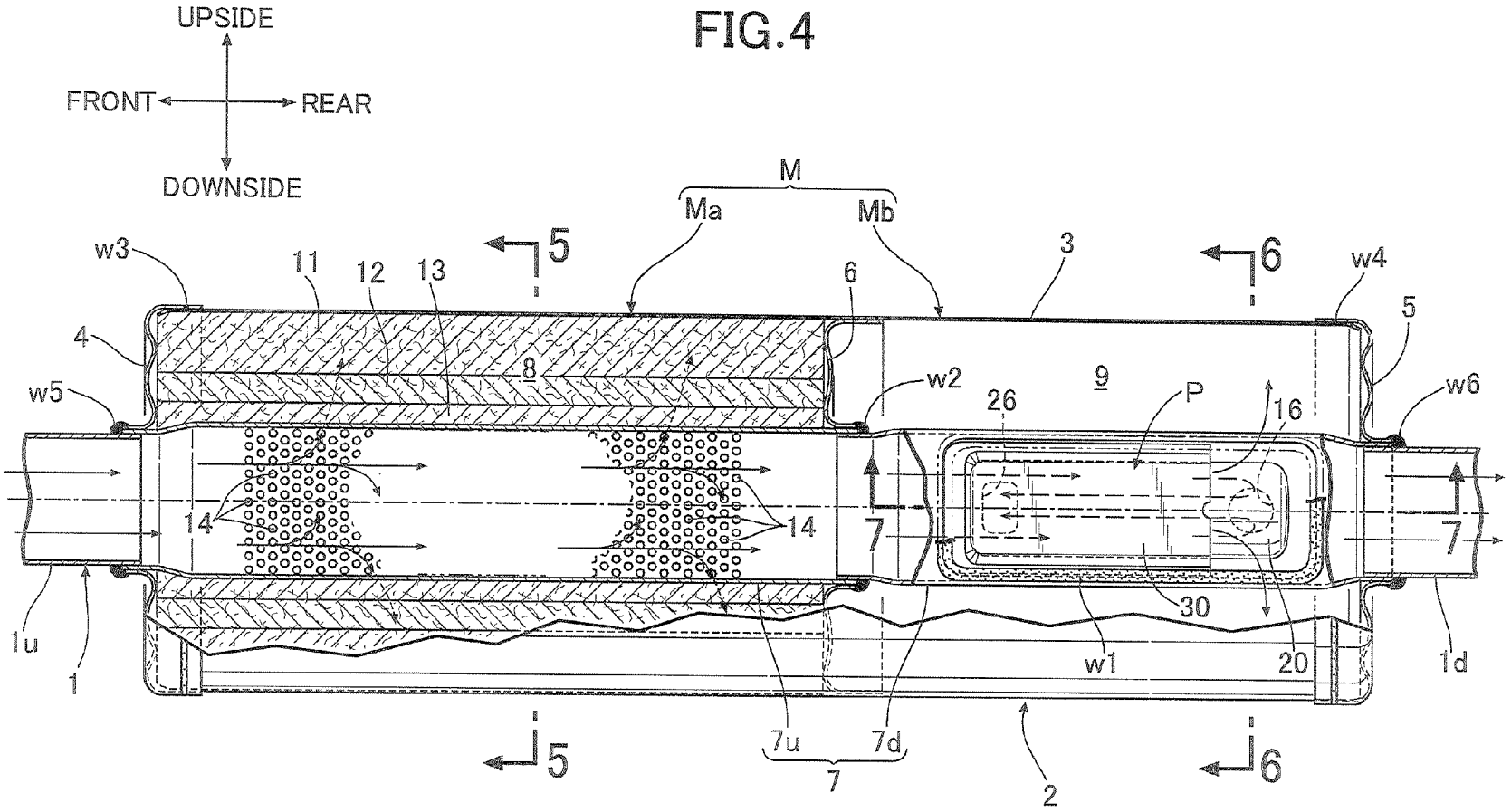
FIG. 4 is a sectional view taken along a line 4-4 in FIG. 2.

As shown in FIGS. 2 and 4, an upstream-side exhaust pipe 1*u*, together with the front end plate 4, is MIG-welded (w5) with the front end (upstream end) of the upstream-side inner pipe 7*u* over the entire periphery, and a downstream-side exhaust pipe 1*d*, together with the rear end plate 5, is MIG-welded (w6) with the rear end (downstream end) of the downstream-side inner pipe 7*d* over the entire periphery.

Figure 5:
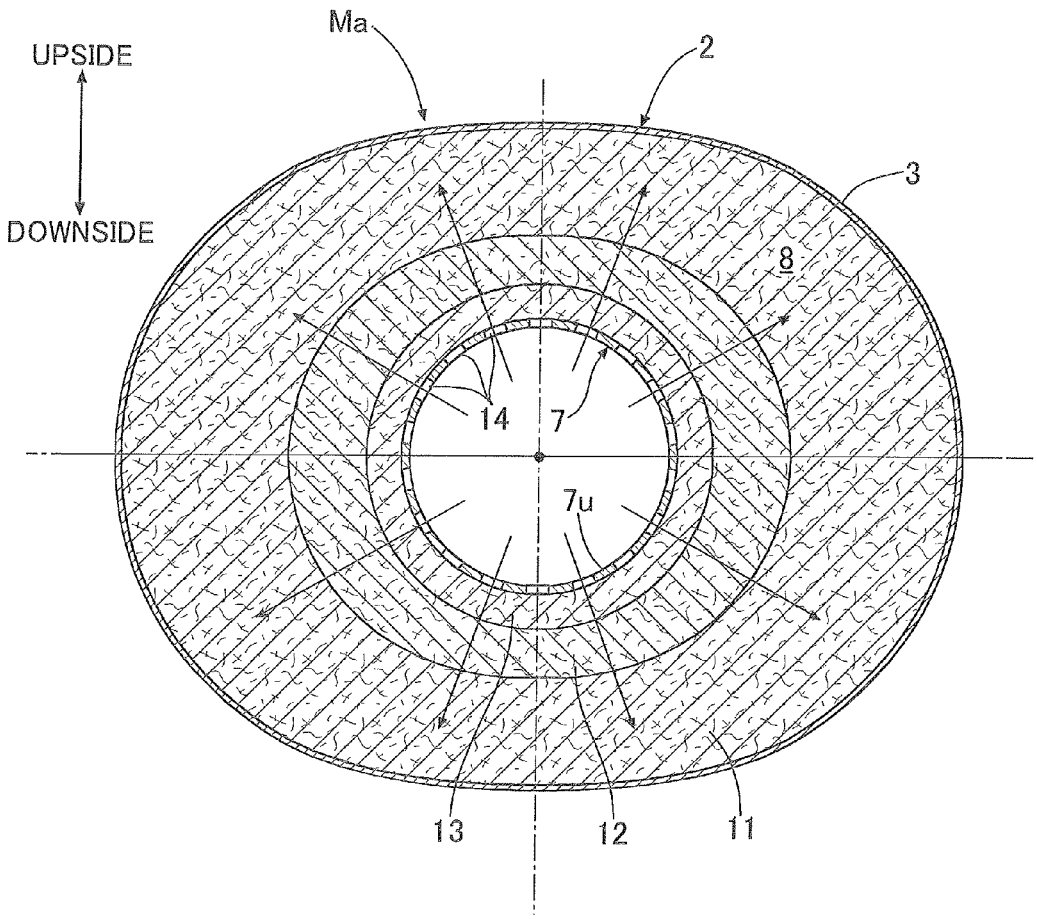
FIG. 5 is an enlarged sectional view taken along a line 5-5 in FIG. 4.

As shown in FIGS. 2, 4 and 5, the inside of the shell 2 is separated into a sound absorption chamber 8 on the front side of the inner plate 6 and a resonance chamber 9 on the rear side thereof. The sound absorption chamber 8 is filled with an outer sound-absorbing material 11, an inner sound-absorbing material 12, and stainless wool 13 which are formed into an elliptic cylindrical shape and are stacked on top of one another, respectively, from the outer side to the inner side in a radial direction of the shell 2. The outer sound-absorbing material 11 is made of glass wool, and the inner sound-absorbing material 12 is made of glass wool more heat-resistant than the outer sound-absorbing material 11. A large number of air holes 14, which are punched holes, are provided in the upstream-side inner pipe 7*u*. Some of the exhaust gas flowing through the inner pipe 7 passes through the air holes 14 to flow in the sound absorption chamber 8, and exhaust noise thereof is reduced by the sound-absorbing materials 12, 11. The stainless wool 13 prevents a fiber forming the sound-absorbing materials 12, 11 from drawn into the upstream-side inner pipe 7*u* through the air holes 14 in the upstream-side inner pipe 7*u*.

In the resonant-type muffler Mb formed in a rear portion of the shell 2, the sealed resonance chamber 9 is formed in a space between an outer peripheral surface of the downstream-side inner pipe 7*d* and the inner peripheral surface of the outer pipe 3. The inside of the resonance chamber 9 and the downstream-side inner pipe 7*d* mutually communicate through a single hole 16 formed in a pipe wall of the downstream-side inner pipe 7*d* and a connection passage P provided on the pipe wall of the downstream-side inner pipe 7*d*. The resonant-type muffler Mb is configured such that exhaust gas flowing through the inner pipe 7 flows in the resonance chamber 9 through the hole 16 and the connection passage P so that exhaust noise of the same frequency (or close to the same frequency) as a resonant frequency of the resonance chamber 9 can be reduced.

The hole 16 is formed in a side portion of the rear portion (downstream portion) of the pipe wall of the downstream-side inner pipe 7*d* for the resonance chamber 9, and is connected to the inside of the resonance chamber 9 through the connection passage P.

Next, a structure of the connection passage P will be described by referring to FIGS. 3, 4, 6 and 7.

The connection passage P includes an inner passage-forming member 20 and an outer passage-forming member 30 which are stacked and overlapped with each other in a radial direction of the downstream-side inner pipe 7*d*. The inner passage-forming member 20 is formed by press-molding a plate material to have a rectangular shape extending in an axial direction of the downstream-side inner pipe 7*d*. A cross section of the inner passage-forming member 20 has an arc shape (a protruding shape) bulging outward in the radial direction of the muffler, and an outer peripheral edge thereof is hemmed with an attachment flange 21. The attachment flange 21 is MIG-welded (w1) with one side (the left side in the front-rear direction) of the outer peripheral surface of the downstream-side inner pipe 7*d* over the entire periphery of the flange. In addition, a space between the inner passage-forming member 20 and the downstream-side inner pipe 7*d* forms an inner passage 22 which extends in the axial direction of the inner pipe 7 and is one of multiple sections of the connection passage P. A closing portion 24 is formed on a base end side of the connection passage P, that is, on a base end side (downstream side) 23 of the inner passage-forming member 20. The base end side 23 including the closing portion 24 covers the hole 16. Moreover, a communication hole 26 is formed in an upstream-side end portion 25 of the inner passage-forming member 20. The inner passage 22 and an outer passage 32 to be described later communicate with each other through the communication hole 26.

The outer passage-forming member 30 is overlapped with the inner passage-forming member 20 outwardly in the radial direction and is formed by press-molding a plate material and has a rectangular shape which extends in the axial direction of the downstream-side inner pipe 7*d*. The outer passage-forming member 30 is shorter than the inner passage-forming member 20. A cross section of the outer passage-forming member 30 has a squared U shape (a protruding shape) bulging outward in the radial direction. An attachment flange 31 formed around an outer peripheral edge of the outer passage-forming member 30 except a tip end side (downstream side) 35 is MIG-welded (w1) with the attachment flange 21 of the inner passage-forming member 20. A closing portion 34 is formed on an upstream-side end portion 33 of the outer passage-forming member 30, and the upstream-side end portion 33 including the closing portion 34 covers the communication hole 26 of the inner passage-forming member 20. The outer passage-forming member 30 is made shorter in the axial direction than the inner passage-forming member 20. The tip end side (downstream side) 35 of the outer passage-forming member 30 is opened above the inner passage-forming member 20 to the resonance chamber 9 and is a tip end side of the connection passage P. Moreover, a space between the outer passage-forming member 30 and the inner passage-forming member 20 forms the outer passage 32 which is one of the multiple sections of the connection passage P.

The inner passage 22 and the outer passage 32 have different distances in the radial direction from the outer peripheral surface of the downstream-side inner pipe 7*d*, are mutually overlapped and stacked in the axial direction on the outer peripheral surface of the downstream-side inner pipe 7*d* to be connected in series, and form the single long continuous connection passage P. The exhaust gas flowing through the inner pipe 7 passes through the single long continuous connection passage P into the resonance chamber 9. Specifically, the exhaust gas flows through the hole 16 in the downstream-side inner pipe 7*d* to the inside of the inner passage 22, from the downstream side to the upstream side inside the inner passage 22, through the communication hole 26 to the inside of the outer passage 32, and from the upstream side to the downstream side inside the outer passage 32. That is, the exhaust gas flows into the resonance chamber 9 through the inner passage 22 and the outer passage 32 in such a manner as to zigzag in the axial direction through positions opposed to each other.

Next, the order of assembling the muffler M1 according to the present invention will be described by referring to FIGS. 8A to 8D.

(1) As shown in FIG. 8A, the outer passage-forming member 30 and the inner passage-forming member 20 are temporarily fixed to each other by spot-welding (at 3 positions), and attached to the outer peripheral surface of the downstream-side inner pipe 7*d* by the MIG-welding (w1).

(2) As shown in FIG. 8B, the stainless wool 13, the inner sound-absorbing material 12, and the outer sound-absorbing material 11 are wound around an outer periphery of the upstream-side inner pipe 7*u*, and the inner plate 6 is fitted to a downstream end of the upstream-side inner pipe 7*u*. Thereafter, the upstream end of the downstream-side inner pipe 7*d* is fitted to the downstream end of the upstream-side inner pipe 7*u*, and then the downstream-side inner pipe 7*d*, the upstream-side inner pipe 7*u*, and the inner plate 6 are MIG-welded (w2) together over the entire peripheries thereof, so that a subassembly SA is manufactured.

(3) As shown in FIG. 8C, the subassembly SA is inserted into the outer pipe 3, and then the front and rear end plates 4, 5 are fitted to the opposite ends of the outer pipe 3, respectively. The outer peripheries of the front and rear end plates 4, 5 are laser-welded (w3, w4) with the outer pipe 3 over the entire peripheries thereof.

(4) As shown in FIG. 8D, the support hole of the front end plate 4 and the front end of the upstream-side inner pipe 7*u* are temporarily fixed together at one position by spot-welding, and the support hole of the rear end plate 5 and the rear end of the downstream-side inner pipe 7*d* are temporarily fixed together at one position by spot-welding. Thereafter, the upstream-side exhaust pipe 1*u* is fitted to the upstream-side inner pipe 7*u*, and then the front end plate 4, the upstream-side inner pipe 7*u*, and the upstream-side exhaust pipe 1*u* are MIG-welded (w5) together over the entire peripheries thereof. Subsequently, the downstream-side exhaust pipe 1*d* is fitted to the downstream-side inner pipe 7*d*, and the rear end plate 5, the downstream-side inner pipe 7*d*, and the downstream-side exhaust pipe 1*d* are MIG-welded (w6) together over the entire peripheries thereof.

Next, a description is given of operations of this exemplary embodiment.

While flowing through the exhaust system Ex, the exhaust gas flows through the catalytic converter C to remove harmful components contained therein and passes through the upstream-side exhaust pipe 1*u* to flow in the first muffler M1 to be subjected to the first noise reduction. Thereafter, the exhaust gas passes through the downstream-side exhaust pipe 1*d* to flow in the second muffler M2 to be subjected to the second noise reduction. Then, the exhaust gas is released to outside air.

Meanwhile, when flowing in the first muffler M1 according to the present invention, the exhaust gas flows in the absorption muffler Ma formed in the upstream-side portion of the shell 2 passing through the upstream-side inner pipe 7*u*. In the absorption muffler Ma, some of the exhaust gas passes through the large number of air holes 14 from the upstream-side inner pipe 7*u* to flow in the sound absorption chamber 8. Here, the exhaust noise is absorbed into the inner and outer sound-absorbing materials 12, 11, so that high-frequency exhaust noise is reduced.

The exhaust gas flowing through the inner pipe 7 also flows in the resonant-type muffler Mb formed in the downstream-side portion of the shell 2. In the resonant-type muffler Mb, the exhaust gas flows through the downstream-side inner pipe 7*d*, into the hole 16 provided in the downstream-side inner pipe 7*d*, and through the connection passage P into the resonance chamber 9. In the resonance chamber 9, the exhaust noise is reduced which has low frequencies the same as and close to the predetermined low frequency set for the resonance chamber 9.

In this exemplary embodiment, the connection passage P connecting the hole 16 formed in the downstream-side inner pipe 7*d* and the resonance chamber 9 is formed as a single long continuous passage by the inner passage 22 and the outer passage 32 which are connected in series and mutually overlapped extending in the axial direction. Thus, the length of the connection passage P can be made longer in a limited length range, in the axial direction, of the downstream-side inner pipe 7*d*. Thereby, the resonance frequency of the resonance chamber 9 can be sufficiently shifted toward a lower frequency, and can be readily set at a desired lower frequency. The connection passage P configured as described herein is particularly preferable for a resonance chamber 9 having a shape short in the axial direction and long in the radial direction as in this exemplary embodiment.

Note that in this exemplary embodiment, high-frequency exhaust noise is absorbed in a portion which is the absorption muffler Ma and low-frequency exhaust noise is absorbed in a portion which is the resonant-type muffler Mb according to the present invention.

In addition, in this exemplary embodiment, since the inner passage-forming member 20 and the outer passage-forming member 30 are formed to have cross sections of protruding shapes and have closing portions 24, 34 on one end thereof in the longitudinal direction, the inner passage-forming member 20 and the outer passage-forming member 30 can be manufactured easily by press molding.

An exemplary embodiment of the present invention has heretofore been described. However, the present invention is not limited to the above-described exemplary embodiment, and various embodiments can be carried out within the scope of the present invention.

For example, in the above-described exemplary embodiment, the muffler according to the present invention is implemented by the first muffler M1 located on the upstream side of the second muffler M2, but may be implemented by the second muffler M2. In addition, in the above-described exemplary embodiment, the muffler according to the present invention is provided so as to be adjacent to and integral with the absorption muffler, but may be implemented as an independent muffler as a matter of course. Moreover, in the above-described exemplary embodiment, the "multiple passages mutually overlapped extending in the axial direction" are formed by the two sections, i.e., the inner passage 22 and the outer passage 32, but may be formed by three or more passages.

Figure 6:
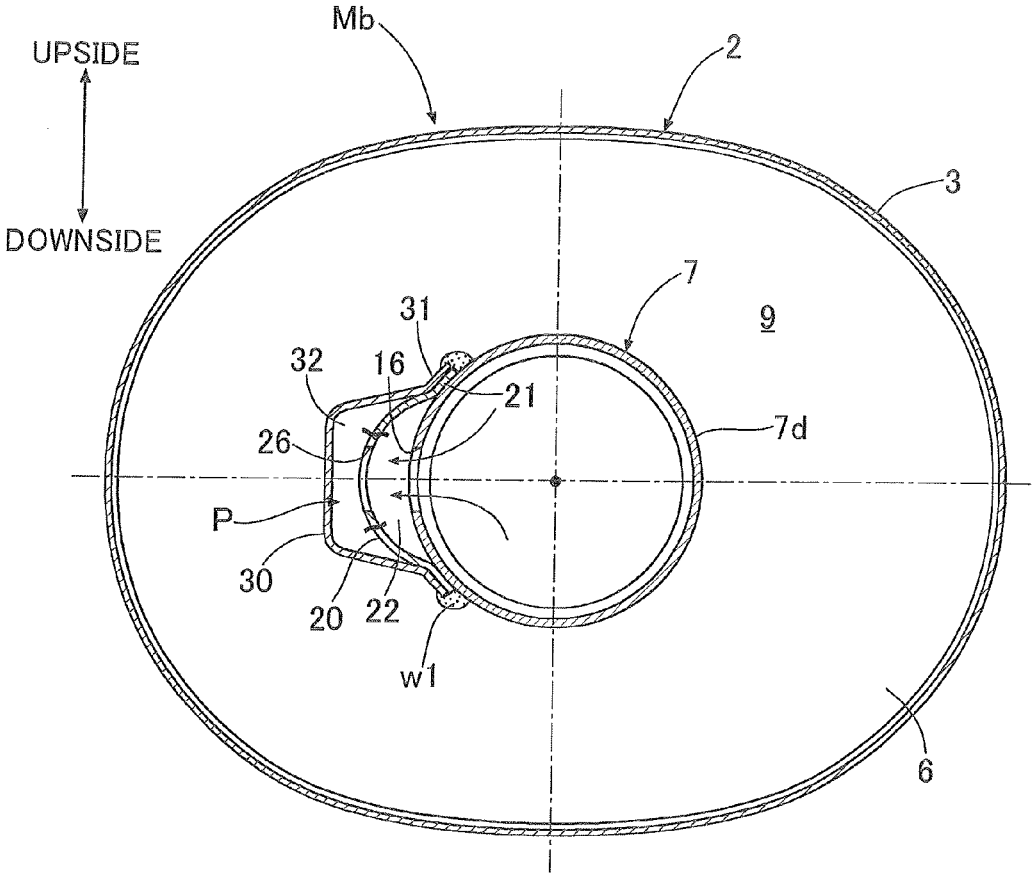
FIG. 6 is an enlarged sectional view taken along a line 6-6 in FIG. 4.
Figure 7:
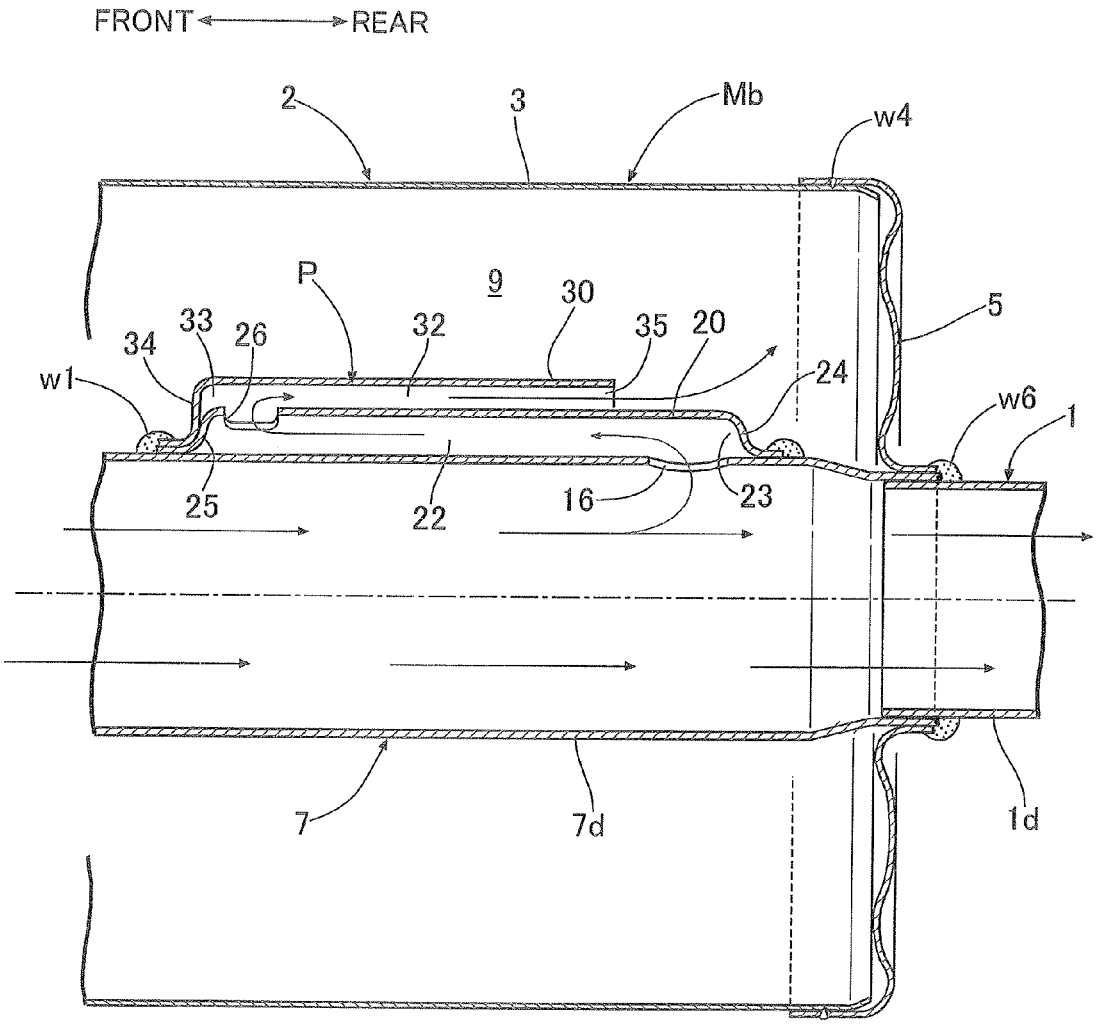
FIG. 7 is an enlarged sectional view taken along a line 7-7 in FIG. 4.

Further, in the above-described exemplary embodiment, the "connection passage P" is formed in a portion of the outer peripheral surface of the inner pipe 7 in a circumferential direction, like that in FIG. 6 in Patent Document 1. However, the "connection passage P" may be formed so as to completely surround the outer peripheral surface of the inner pipe 7.

What is claimed is:

1. A muffler comprising:

an inner pipe having one end connected to an upstream side of an exhaust pipe of an engine exhaust system, and another end connected to a downstream side of the exhaust pipe;

an outer pipe covering at least part of the inner pipe, a hole being formed in a pipe wall of the inner pipe, the outer pipe defining part of an outer shell of the muffler;

a resonance chamber formed in a space between the inner pipe and the outer pipe and extending to an inner surface of the outer pipe; and a connection passage formed on an outer peripheral surface of the inner pipe along an axial direction of the inner pipe, the connection passage having a base end side connected to the hole and a tip end side connected to the resonance chamber, wherein an inside of the inner pipe and the resonance chamber communicate with each other through the hole and the connection passage, wherein the tip end side of the connection passage is in fluid communication with the resonance chamber, and wherein the connection passage comprises a plurality of sections connected in series to form the connection passage as a single continuous passage extending from said base end side thereof to said tip end side thereof, the plurality of sections having different distances from the outer peripheral surface of the inner pipe in a radial direction thereof and being mutually overlapped and extending in the axial direction on the outer peripheral surface of the inner pipe.

2. The muffler according to claim 1, wherein a plurality of passage-forming members each having a cross section of a protruding shape bulging outward in the radial direction from the outer peripheral surface of the inner pipe and having a closing portion on one end in a longitudinal direction thereof are stacked on the outer peripheral surface of the inner pipe such that the longitudinal direction coincides with the axial direction and that locations of the closing portions of adjacent ones of the passage forming members are opposed to each other, the closing portions close spaces formed inside the passage-forming members in the longitudinal direction, and the sections of the communication passage are formed as spaces between the plurality of passage-forming members and the inner pipe.

3. The muffler according to claim 2, wherein at least one of passage-forming members has a communication hole formed therein, wherein said at least one communication hole connects said sections of the communication passage.

4. The muffler according to claim 2, wherein said passage-forming members are affixed to the inner pipe by a common weld.

5. The muffler according to claim 2, wherein said passage-forming members are formed by press molding plate material and are fixed to the inner pipe and to each other by welding.

6. A muffler comprising:

an inner pipe having one end connected to an upstream side of an exhaust pipe of an engine exhaust system, and another end connected to a downstream side of the exhaust pipe;

an outer pipe covering at least part of the inner pipe, a hole being formed in a pipe wall of the inner pipe;

a resonance chamber formed in a space between the inner pipe and the outer pipe;

a first passage-forming member;

a second passage-forming member, and a connection passage formed on an outer peripheral surface of the inner pipe along an axial direction of the inner pipe, the connection passage having a base end side connected to the hole and a tip end side connected to the resonance chamber, wherein:

an inside of the inner pipe and the resonance chamber communicate with each other through the hole and the connection passage, the connection passage comprises a plurality of sections connected in series to form the connection passage as a single continuous passage extending from said base end side thereof to said tip end side thereof, the plurality of sections having different distances from the outer peripheral surface of the inner pipe in a radial direction thereof and being mutually overlapped and extending in the axial direction on the outer peripheral surface of the inner pipe, said first passage-forming member has a cross section of a protruding shape bulging outward in the radial direction of the muffler, and has closing portions on both longitudinal ends thereof, said second passage-forming member has a cross section of a protruding shape bulging outward in the radial direction of the muffler, and has a closing portion on one end thereof and an opposite end open to said resonance chamber, said first passage-forming member and said second-passage forming member are stacked on the outer peripheral surface of the inner pipe such that the longitudinal direction coincides with the axial direction, the closing portions close spaces formed inside the passage-forming members in the longitudinal direction, and the sections of the communication passage are formed as spaces between the first pas sage- forming member and the inner pipe, and between the second passage-forming member and the first passage-forming member.

7. The muffler according to claim 6, wherein the first passage-forming member is disposed on the outer surface of the inner pipe and the second passage-forming member is disposed on the first passage-forming member.

8. The muffler according to claim 6, wherein the first and second passage-forming members are affixed to the inner pipe by a common weld.

9. The muffler according to claim 7, wherein the first and second passage-forming members are affixed to the inner pipe by a common weld.

10. The muffler according to claim 6, wherein said passage-forming members are formed by press molding plate material and are fixed to the inner pipe and to each other by welding.

11. The muffler according to claim 6, further comprising a communication hole formed in an end of said first passage-forming member opposite the hole formed in a pipe wall of the inner pipe, wherein said communication hole connects said sections of the communication passage.

12. A muffler comprising:

an inner pipe having one end connected to an upstream side of an exhaust pipe of an engine exhaust system, and another end connected to a downstream side of the exhaust pipe;

an outer pipe covering at least part of the inner pipe, the outer pipe defining part of an outer shell of the muffler, a hole being formed in a pipe wall of the inner pipe;

an absorption chamber formed in a space between the inner pipe and the outer pipe, said absorption chamber being filled with a sound absorption material;

a resonance chamber formed in a space between the inner pipe and the outer pipe and extending to an inner surface of the outer pipe, said absorption chamber and said resonance chamber being separated by an inner plate; and a connection passage formed on an outer peripheral surface of the inner pipe along an axial direction of the inner pipe, the connection passage having a base end side connected to the hole and a tip end side connected to the resonance chamber, wherein the tip end side of the connection passage is in fluid communication with the resonance chamber, wherein an inside of the inner pipe and the resonance chamber communicate with each other through the hole and the connection passage, and wherein the connection passage comprises a plurality of sections connected in series to form the connection passage as a single continuous passage extending from said base end side thereof to said tip end side thereof, the plurality of sections having different distances from the outer peripheral surface of the inner pipe in a radial direction thereof and being mutually overlapped and extending in the axial direction on the outer peripheral surface of the inner pipe.

13. The muffler according to claim 12, wherein a plurality of air holes are provided in a portion of the inner pipe which runs through the absorption chamber, a portion of an exhaust gas which flows through said inner pipe passes through said air holes and part of an exhaust noise of said portion of exhaust gas is absorbed by said sound-absorbing material.

14. The muffler according to claim 12, wherein a plurality of passage-forming members each having a cross section of a protruding shape bulging outward in the radial direction from the outer peripheral surface of the inner pipe and having a closing portion on one end in a longitudinal direction thereof are stacked on the outer peripheral surface of the inner pipe such that the longitudinal direction coincides with the axial direction and that locations of the closing portions of adjacent ones of the passage forming members are opposed to each other, the closing portions close spaces formed inside the passage-forming members in the longitudinal direction, and the sections of the communication passage are formed as spaces between the plurality of passage-forming members and the inner pipe.

15. The muffler according to claim 14, wherein the plurality of passage-forming members are affixed to the inner pipe by a common weld.

16. The muffler according to claim 13, wherein a plurality of passage-forming members each having a cross section of a protruding shape bulging outward in the radial direction from the outer peripheral surface of the inner pipe and having a closing portion on one end in a longitudinal direction thereof are stacked on the outer peripheral surface of the inner pipe such that the longitudinal direction coincides with the axial direction and that locations of the closing portions of adjacent ones of the passage forming members are opposed to each other, the closing portions close spaces formed inside the passage-forming members in the longitudinal direction, and the sections of the communication passage are formed as spaces between the plurality of passage-forming members and the inner pipe.

17. The muffler according to claim 14, wherein at least one of the passage-forming members has a communication hole formed therein, and wherein said at least one communication hole connects said sections of the communication passage.

18. The muffler according to claim 16, wherein at least one of the passage-forming members has a communication hole formed therein, and wherein said at least one communication hole connects said sections of the communication passage.

19. A muffler comprising:

an inner pipe having one end connected to an upstream side of an exhaust pipe of an engine exhaust system, and another end connected to a downstream side of the exhaust pipe;

an outer pipe covering at least part of the inner pipe, a hole being formed in a pipe wall of the inner pipe;

an absorption chamber formed in a space between the inner pipe and the outer pipe, said absorption chamber being filled with a sound absorption material;

a resonance chamber formed in a space between the inner pipe and the outer pipe, said absorption chamber and said resonance chamber being separated by an inner plate;

a connection passage formed on an outer peripheral surface of the inner pipe along an axial direction of the inner pipe, the connection passage having a base end side connected to the hole and a tip end side connected to the resonance chamber;

a first passage-forming member and a second passage-forming member, said first passage-forming member having a cross section of a protruding shape bulging outward in the radial direction of the muffler, and having closing portions on both longitudinal ends thereof, said second passage-forming member having a cross section of a protruding shape bulging outward in the radial direction of the muffler, and having a closing portion on one end thereof and having an opposite end open to said resonance chamber, wherein:

an inside of the inner pipe and the resonance chamber communicate with each other through the hole and the connection passage, the connection passage comprises a plurality of sections connected in series to form the connection passage as a single continuous passage extending from said base end side thereof to said tip end side thereof, the plurality of sections having different distances from the outer peripheral surface of the inner pipe in a radial direction thereof and being mutually overlapped and extending in the axial direction on the outer peripheral surface of the inner pipe, said first passage-forming member and said second-passage forming member are stacked on the outer peripheral surface of the inner pipe such that the longitudinal direction coincides with the axial direction, the closing portions close spaces formed inside the passage-forming members in the longitudinal direction, and the sections of the communication passage are formed as spaces between the first passage-forming member and the inner pipe, and between the second passage-forming member and the first passage-forming member.

20. The muffler according to claim 19, further comprising a communication hole formed in an end of said first passage-forming member opposite the hole formed in a pipe wall of the inner pipe, wherein said communication hole connects said sections of the communication passage.

* * * * *

UNITED STATES PATENT AND TRADEMARK OFFICE

CERTIFICATE OF CORRECTION

PATENT NO. : 8,550,210 B2
APPLICATION NO. : 13/443109
DATED : October 8, 2013
INVENTOR(S) : Takeharu Kondou It is certified that error appears in the above-identified patent and that said Letters Patent is hereby corrected as shown below:

Title page, (75) Inventor:

Change "Takaharu Kondou" to --Takeharu Kondou--

Signed and Sealed this
Tenth Day of December, 2013

Margaret A. Focarino

Margaret A. Focarino
*Commissioner for Patents of the United States Patent and Trademark Office*